United States Patent [19]

Jacobsen

[11] Patent Number: 4,958,455

[45] Date of Patent: Sep. 25, 1990

[54] PIVOTLESS WHEEL INDICIA DISPLAY DEVICE

[75] Inventor: Roger V. Jacobsen, Chicago, Ill.

[73] Assignee: Gary Jacobsen, Bensenville, Ill.

[21] Appl. No.: 352,768

[22] Filed: May 16, 1989

[51] Int. Cl.[5] ..... G09F 11/04

[52] U.S. Cl. ..... 40/495

[58] Field of Search ..... 40/642, 495, 155, 152, 40/493

[56] References Cited

U.S. PATENT DOCUMENTS

| | | | |
|---|---|---|---|
| 1,525,640 | 2/1925 | Bryant | 40/495 |
| 1,714,159 | 5/1929 | Crawford | 40/495 |
| 2,016,445 | 10/1935 | Massey | 40/495 |
| 2,755,577 | 7/1956 | Greensfelder | 40/495 |
| 2,787,852 | 4/1957 | Youngren | 40/495 |
| 2,842,877 | 7/1958 | Stevens | 40/495 |
| 3,103,080 | 9/1963 | Desmond | 40/495 |
| 3,820,263 | 6/1974 | Clark | 40/495 |
| 4,323,609 | 4/1982 | Brombero | 40/495 |
| 4,373,281 | 2/1983 | Sebastian | 40/495 |
| 4,559,253 | 12/1985 | Thallinger | 40/495 |

FOREIGN PATENT DOCUMENTS

| | | | |
|---|---|---|---|
| 626733 | 9/1927 | France | 40/495 |

*Primary Examiner*—James R. Brittain
*Assistant Examiner*—J. Hakomaki
*Attorney, Agent, or Firm*—Welsh & Katz, Ltd.

[57] ABSTRACT

An indicia display device formed from a single piece of paper stock comprising a rotatable wheel element having indicia fixed thereon, a circular pocket for pivotlessly and rotatably mounting the rotatable wheel element in the circular pocket, and a viewing opening through which indicia on the wheel element are selectively visible.

12 Claims, 2 Drawing Sheets

PIVOTLESS WHEEL INDICIA DISPLAY DEVICE

FIELD OF THE INVENTION

This invention relates to a wheel indicia display device. More particularly, this invention relates to an indicia display device having a pivotless wheel element that is rotatably mounted in a circular pocket or cavity and that displays information and/or advertising indicia.

BACKGROUND OF THE INVENTION

A variety of involvement action devices or wheel-like elements that display information or advertising material are known. Involvement action devices include wheel-like elements which are manually rotated by the user and provide varying elements of information. However, it has been discovered that while such involvement action devices are popular, there are problems associated with their use including frequent breakage and great expense of manufacture.

There are presently available devices having manually rotatable internal wheel-like elements that display information or advertising indicia. For example, Bradley U.S. Pat. No. 1,715,737 and Sulger U.S. Pat. No. 2,748,514 illustrate devices having manually rotatable internal wheel-like elements. However, these devices each contemplate having a fixed pivot, in the nature of a rivet or the like, for rotatably mounting the rotatable element to the advertising device's carrier.

Other rotatable wheel elements include devices having a wheel which is secured by flanges that project around the perimeter of the wheel. However, these devices, as well as those of the prior art cited above are relatively costly to manufacture and break easily due to their particular type of construction.

Accordingly, an object of the present invention is to provide an information or advertising display device having a wheel element that is pivotless, providing a unique method of manufacturing compared to current methods of manufacture.

Another object of the present invention is to provide an information or advertising display device including a pivotless wheel element that is manually rotatable and mounted in a circular pocket formed in the device, whereby the pocket forms an internal locking device for the wheel element.

Another object of the present invention is to provide a pivotless wheel element for an indicia display device that is die-cut from a single sheet of flat paper stock.

A further object of the present invention is to provide a pivotless wheel element that is relatively inexpensive to manufacture, and is capable of being produced in mass quantities within a short period of time compared to the standard method, which involves slower and costly production procedures.

SUMMARY OF THE INVENTION

The present invention, in the preferred embodiment, comprises a structure that accomplishes the foregoing objects by providing an involvement action indicia display device having a pivotless wheel element that is manually rotatably mounted in a circular pocket. The pivotless wheel element displays information and/or advertising indicia through cut-outs or/and die-cut windows in the structure.

The pivotless wheel element and its circular retention pocket are die-cut from one sheet of paper stock, from either a single web or double web method of a web printing press, wherein the die-cut paper stock is folded over, gummed, and cut to form the circular pocket which forms an internal locking device that holds the pivotless wheel element for manual rotation. It is precisely this inventive construction of the wheel element and circular locking or retention pocket, which involves the die-cutting, gumming, and folding of a single sheet of paper, that enables the wheel element to be constructed and rotatably mounted without a fixed pivot and to further be manufactured without great expense. This new manufacturing method eliminates the need for any assistance from human hand production methods. The pivotless wheel element is produced entirely in-line on the web printing press equipped with an in-line finishing system. During the manufacturing process, the wheel is delivered off the press without any further assistance by human hand operations, or additional off-line (post) machine operations.

In a further embodiment, the inventive device also accomplishes the aforementioned objects by providing a plurality of wheel elements, which are adjacent each other, that are pivotless and which are manually mounted in circular pockets within the same device. The pivotless wheel elements also display information and/or advertising indicia. These pivotless wheel elements and their circular retention pockets are similarly die-cut, gummed and folded from a single sheet of paper, as in the preferred embodiment.

In yet another embodiment, the inventive device also accomplishes the aforementioned objects by providing one or more wheel elements that are pivotless, which are manually mounted in circular pockets, and which display information and/or advertising indicia disposed on the pivotless wheel or wheels through apertures or windows which are located on the external surface of the circular retention pocket.

All of the aforementioned embodiments are adapted to be self-mailed without the use of a separate outer carrier envelope, if desired. The construction of the self-mailed pivotless wheel element and circular retention pocket is the same as the wheel elements of the other embodiments. Moreover, all of the embodiments may be removably attached to the inside seam of a saddle stitched or perfect bound magazine or book for mass distribution. The present invention can be used for any direct mail promotion, free standing insert, magazine advertising inserts, sweepstake contests, or any field which uses mass produced printing for commercial advertising.

Thus, the present invention provides a pivotless wheel element that is rotatably mounted in a circular pocket and which further provides a vehicle for the display of information and/or advertising material. The inventive device is relatively inexpensive to manufacture, yet is more sturdy and durable than the previously described wheel-like elements of the prior art.

The above, as well as other objects and advantages of the invention, will become apparent from the following detailed description of the preferred embodiments, reference being made to the accompanying drawings.

DETAILED DESCRIPTION OF THE INVENTION

Figure 1:
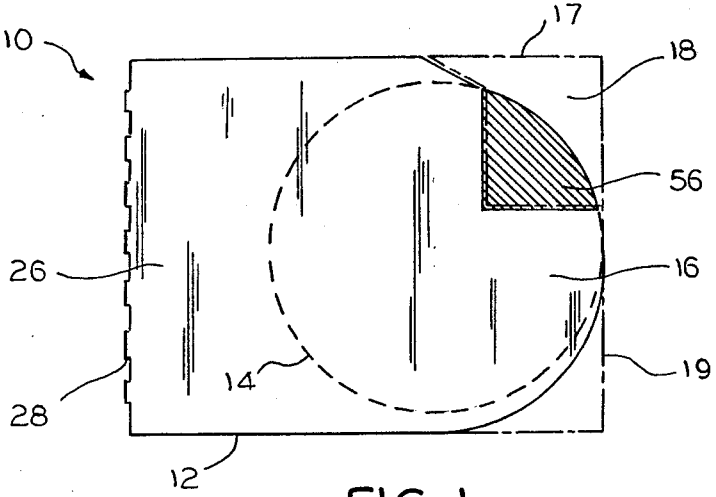
FIG. 1 is a plan view of the inventive indicia display device, illustrating the pivotless wheel element and circular pocket for the pivotless wheel.

Referring first to FIG. 1, the invention provides a pivotless wheel indicia display device generally denoted by the numeral 10 having, in part a generally rectangular or square body 12, circular cavity or pocket 14, wheel element 16 and wheel opening 18. Generally, circular pocket 14 is formed by tacking down that portion of body 12 which surrounds circular pocket 14, as will be explained in more detail. Wheel element 16 is contained and rotates freely within circular pocket 14 in response to manual manipulation, held in place by the internal locking method formed by gumming, and proper placement of the paper plys and gum.

Figure 2:
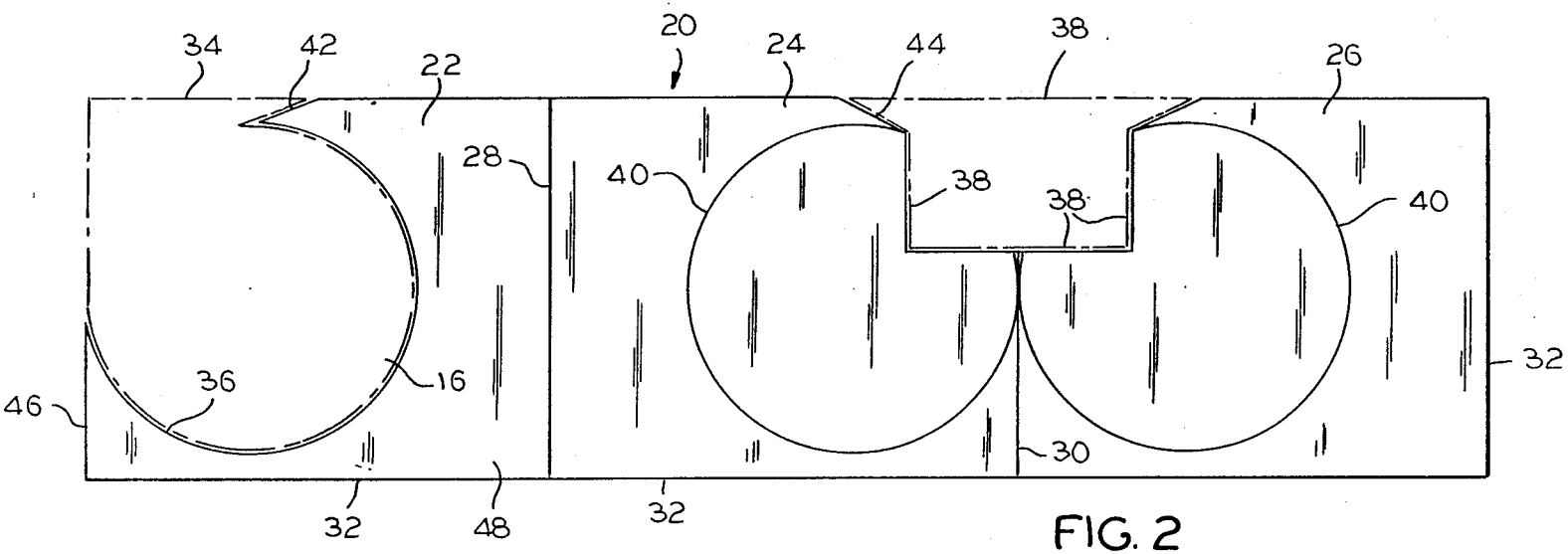
FIG. 2 is a plan view of the three ply panels which are die-cut, gummed and folded to form the inventive indicia display device of FIG. 1.

FIG. 1 shows the preferred embodiment of the inventive device 10 after assembly, which will be described in more detail. The entire device 10 of FIG. 1 is constructed from a single sheet of paper stock as depicted in FIG. 2. In the preferred embodiment the opening 18 is created by removing the portion of paper stock designated by the dotted lines 17 in FIG. 1. Also, if desired, the portion of paper stock indicated by the dotted lines 19 in FIG. 1 can be removed to provide a round or radiused look to the outer edge of the device 10 adjacent the wheel element 16. The removal of both parts designated by the lines 17 and 19 can be accomplished during the production of the device 10 by a rotary trimmer knife system which is usually the last process in an in-line finishing system associated with a web printing press.

FIG. 2 shows a single sheet of paper stock 20 which is diecut from a roll of web paper which is threaded through a conventional in-line web printing press with a rotary knife cutting system within. Paper 20 is generally rectangular in shape and comprises three panels or plys 22, 24, 26 having two score lines 28, 30 for folding plys 22, 24 and plys 24, 26, respectively. The solid line 32 and broken lines 34, 36, 38 outline the outer boundaries of plys 22, 24, 26 as they appear prior to being die-cut by the above mentioned cutting system.

Figure 3:
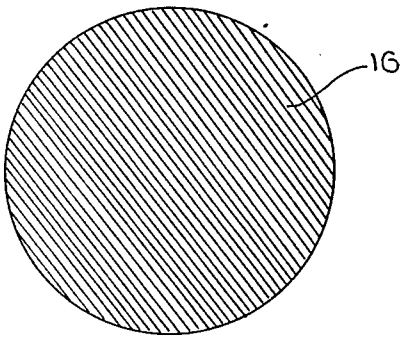
FIG. 3 is a plan view of the inventive pivotless wheel element that was die-cut from one of the panels of FIG. 2.

Ply 22 is die-cut so that the upper and outer corner, as depicted by broken line 34 of FIG. 2 is removed and discarded. Broken line 36 is die-cut from ply 22 in a circular configuration and becomes the wheel element 16, as shown in FIGS. 1 and 3.

Plys 24 and 26 are also die-cut along broken line 38 so that plys 24 and 26 are mirror images of each other. Score line 30 is removed, in part, subsequent to the die-cutting of broken line 38. The circle configuration 40 in plys 24 and 26 illustrated in FIG. 2 are not die-cut but merely represent the approximate location of wheel element 16 upon final assembly of device 10.

Figure 4:
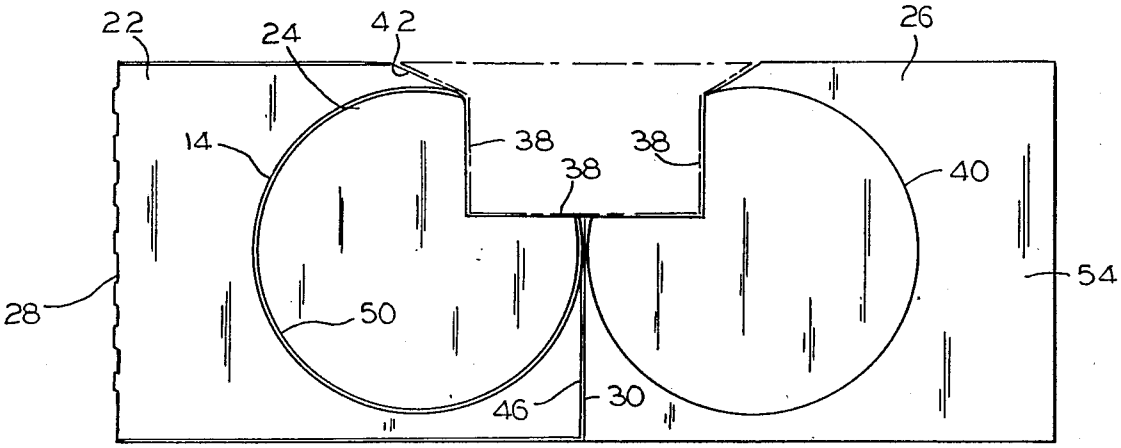
FIG. 4 is a plan view of the inventive circular pocket subsequent of one of the panels of FIG. 2.

After plys 22, 24, 26 have been die-cut as described, ply 22 is folded over and onto ply 24 along score line 28. Edge 42 and side 46 of ply 22 are aligned with edge 44 of ply 24 and score line 30, respectively. This alignment of ply 22 and ply 24 is depicted in FIG. 4. Glue or another adhesive substance is applied to that area of ply 22 designated by numeral 48, whereby ply 22 is securely and completely attached to ply 24.

FIG. 4 illustrates how ply 22 is positioned over ply 24 after ply 22 is folded over and onto ply 24 at score line 28. FIG. 4 further shows that after ply 22 is folded over onto ply 24, a circular portion of ply 24 is exposed. A section of ply 24 was previously die-cut along broken line 38, as explained in connection with FIG. 2.

The inner edge 50 of ply 22 outlines the opening created when ply 22 was die-cut and wheel element 16 was removed. Accordingly, inner edge 50 of ply 22 forms a cavity or circular pocket 14 in which wheel element 16 is rotatably mounted, to provide an internal locking device for wheel element 16 as will be described.

Ply 26 is also shown in FIG. 4, and broken line 38 shows where a portion of ply 26 has been die-cut. Circular configuration 40 shows the approximate location of wheel element 16 as it appears in device 10 of FIG. 1 subsequent to the folding over of ply 26 onto plys 22 and 24. Circular configuration 40 in FIG. 4 is not a die-cut.

After ply 22 has been glued or otherwise adhered to ply 24, ply 26 is similarly coated with glue or similar adhesive substance in the region 54 on ply 26 located outside circular configuration 40. Glue or adhesive is also applied to the region 55 of ply 22 outside of edge 50, as shown in FIG. 4. Wheel element 16, as seen in FIG. 3, is placed in circular pocket 14. Ply 26 is then folded over along score line 30 and onto ply 22. The glue or adhesive substance secures ply 24 to ply 26, and securely retains wheel element 16 internally in circular pocket 14. As ply 26 is the mirror image of ply 24, and because ply 22 is aligned with ply 24, ply 26 is symmetrical with plys 22 and 24, as shown in FIG. 1.

Referring again to FIG. 1, device 10 is shown with ply 26 covering plys 22 and 24. Score lines 28 and 30 define the side edges of device 10. The wheel opening 18 is the result of the removal of portions 34 and 38 of plys 22, 24 and 26. As ply 26 was die-cut along broken lines 38, wheel element 16 is exposed at area 56. Moreover, as no glue or sticky substance was applied to wheel element 16, circular pocket 14, or that area of circular configuration 40 of ply 26 covering wheel element 16, wheel element 16 is pivotlessly and rotatably mounted within circular pocket 14.

Rotation of wheel element 16 of device 10 is performed manually. The user of device 10 simply grasps the exposed portion 56 of wheel element 16 and manually moves the wheel in either direction. Wheel element 16 freely rotates within circular pocket 14. The wheel element 16 has been pre-printed with advertising or other information prior to its insertion into circular pocket 14, which appears selectively in exposed wheel opening 18 (FIG. 1).

Figure 5:
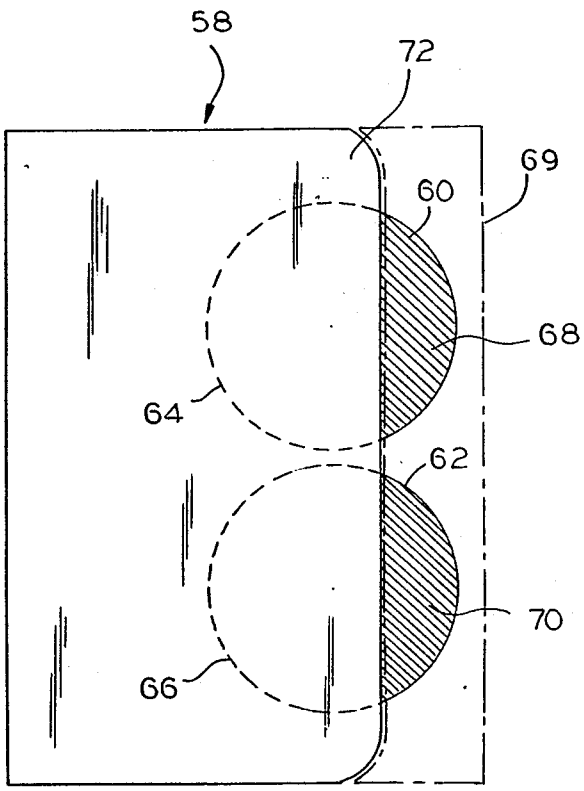
FIG. 5 is a plan view of another embodiment of the inventive device having a plurality of pivotless wheel elements and circular showing a finished, final delivered product.

FIG. 5 illustrates another embodiment of the inventive display device 10. The device 58 of FIG. 5 includes two wheel elements 60, 62 that are rotatably mounted in circular pockets 64, 66, respectively. Exposed area 68, 70 of wheel elements 60, 62, respectively, extend outwardly from edge 72 of device 58. Lines 69 in FIG. 5 represent portions of each ply which have been removed, similar to lines 34, 38 in FIG. 2. Wheel elements 68, 70 freely rotate within circular pockets 64, 66.

Device 58 is generally designed and constructed in the same manner as device 10 of FIG. 1. Device 58 initially consisted of three plys that were die-cut in certain areas and then folded over onto each other along score lines. Die-cut wheel elements 68, 70 are positioned within circular pockets 64, 66 and then encased within the folded plys, as was described in the previously described embodiment. Each wheel element 68, 70 contains pre-printed information or advertising, similar to device 10 of FIG. 1. The wheels 68, 70 are adapted to be manually rotated in pockets 64, 66.

Figure 6:
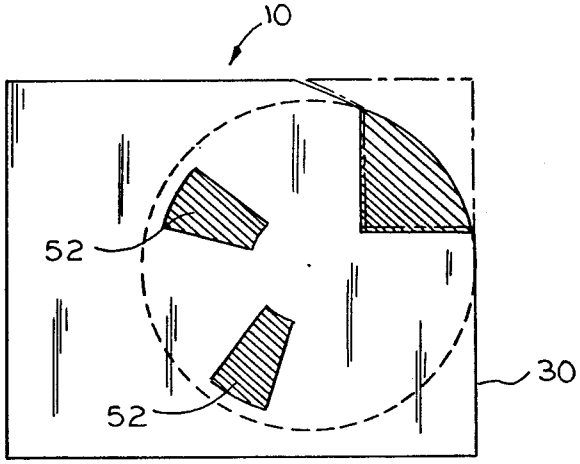
FIG. 6 is a plan view of another embodiment of the inventive device of FIG. 1, having a plurality of viewing apertures preferably formed by using a die-cutting unit within the web presses' in-line finishing system.

FIG. 6 shows another embodiment of the inventive display device 10. This embodiment is exactly the same as the embodiment of FIG. 1, except that the apparatus of FIG. 6 includes additional viewing apertures 52 which are die cut into ply 26 before ply 26 is folded onto ply 24 along score line 30. Apertures 52 simultaneously expose additional areas of wheel element 16. Several apertures 52 may be die-cut from ply 26. Apertures 52 serve to expose more of wheel element 16 and therefore, allow for more information or advertising to be displayed. Apertures 52 may also be included in the above-described embodiment depicted in FIG. 5.

The above-described embodiments are preferably manufactured entirely in one step and on a single press system. An inventive pivotless wheel is produced on the aforementioned single web printing press with a suitable in-line finishing system. The daily production rate during a 24 hour period is from 960,000 wheels (in a 2-out press layout) to 3,840,000 wheels (in an 8-out press layout). The above-cited figures are based on running 20,000 press impressions per hour on a press sheet having the approximate dimensions of $22\frac{3}{4}$ or $23\frac{1}{2} \times 36$ or 38 inches.

The materials from which devices 10 and 58 of the different embodiments are constructed include sturdy, light weight, medium weight or heavy weight paper, subject to limitations of equipment, based on the size of the wheel elements, for example. The devices 10 and 58 are adapted to be able to be die-cut on a conventional die-cutting unit within the web press and its inline finishing system. Wheel elements 16, 60 and 62 are pre-printed with conventional web press lithographic printing means. Devices 10 and 58 are held together and secure wheel elements 16, 60, 62 in circular pockets 14, 64, 66 by the use of any adhesive substance, such as glue, cement, liquid adhesives or the like, which are preferably applied by a gum unit within the web presses in-line finishing system.

Moreover, devices 10, 58 have not been described in terms of approximate measurements of the various components, as it should be understood that the size of devices 10, 58 may vary according to need. Thus, there may be a plurality of sizes of devices 10, 58. The sizes can vary, but are limited to the manufacturing equipment's capabilities.

Therefore, it should be recognized that, while the invention has been described in relation to a preferred embodiment thereof, those skilled in the art, may develop a wide variation of structural details without departing from the principles of the invention. Therefore, the appended claims are to be construed to cover all equivalents falling within the true scope and spirit of the invention.

The invention claimed is:

1. An indicia display device comprising:

rotatable wheel means having said indicia fixed thereon, circular pocket means for pivotlessly mounting said rotatable wheel means for rotation in said pocket means, and a viewing opening in said device through which selected indicia appear, said device being formed from a single sheet of material which is divided into a plurality of panels, said panels being folded over and overlapping each other to form said circular pocket means.

2. The indicia display device of claim 1 wherein said circular pocket means in said device includes a circular edge, and said rotatable wheel element means includes an outer edge which engages said circular edge of said pocket.

3. The indicia display device of claim 1 wherein said viewing opening extends from an outer portion of said circular pocket means towards an edge of said device, said viewing opening exposing a portion of said rotatable wheel means.

4. The indicia display device of claim 3 wherein said indicia on said rotatable wheel means is viewed through said viewing opening.

5. The indicia display device of claim 1 wherein said device includes a plurality of viewing apertures through which selected indicia appear.

6. The indicia display device of claim 1 wherein said rotatable wheel means is a single rotatable wheel, and said circular pocket means includes a single pocket in said device to rotatably and pivotlessly engage said single rotatable wheel.

7. The indicia display device of claim wherein said rotatable wheel means comprises a plurality of rotatable wheels, and said circular pocket means includes a plurality of pockets in said device, each pocket rotatably and pivotlessly engaging one of said rotatable wheels.

8. The indicia display device of claim 7 including a plurality of viewing apertures in said device for viewing said indicia.

9. An indicia display device comprising:

rotatable wheel means having said indicia fixed thereon, circular pocket means for pivotlessly mounting said rotatable wheel means for rotation in said pocket means, viewing opening means in said device through which selected indicia appear, said device formed from a single sheet of flat stock divided into three panels substantially equal in size, the first and second panels partially defined by a first score line and said second and third panels partially defined by a second score line, said first panel having a circular portion and an edge portion adjacent the circular portion cut and removed from said first panel, said second and third panels each having an edge portion cut and removed therefrom, said circular pocket means being formed by folding the remaining portion of said first panel over said second panel along said first score line and adhering said remaining portion of said first panel to said second panel, placing said rotatable wheel means in abutment with edge means of said first panel defined by said circular portion which has been removed from said first panel, folding said third panel over said first and second panels along said second score line and adhering said third panel to said remaining portion of said first panel to partially enclose said rotatable wheel means along said edge means of said first panel and between said second and third panels, and said cut edge portions of said first, second and third panels corresponding and overlying each other to form said opening in said display device through which said rotatable wheel means extends from said device, whereby said rotatable wheel means in pivotlessly and rotatably mounted in said circular pocket means.

10. The indicia display device of claim 9 wherein said circular portion removed from said first panel comprises said rotatable wheel means.

11. The indicia display device of claim 9 including a plurality of circular portions cut and removed from said first panel, said circular pocket means including a plurality of circular pockets formed by folding said remaining portion of said first panel over said second panel along said first score line, and said rotatable wheel means includes a plurality of rotatable wheel elements pivotlessly and rotatably mounted in said circular pocket means.

12. The indicia display device of claim 9 including aperture means in said device through which indicia on said rotatable wheel means are visible.

* * * * *